US005894928A

United States Patent [19]

Chang

[11] Patent Number: 5,894,928

[45] Date of Patent: Apr. 20, 1999

[54] DISPLAY BOX WITH DISPLAY CARD

[75] Inventor: Sung Yong Chang, Palisades Park, N.J.

[73] Assignee: Kiss Products, Inc., Port Washington, N.Y.

[21] Appl. No.: 08/686,096

[22] Filed: Jul. 24, 1996

[51] Int. Cl.[6] ..... B65D 77/28

[52] U.S. Cl. ..... 206/459.5; 220/371; 220/665

[58] Field of Search ..... 40/312, 313; 206/232, 206/459.5, 461, 470, 769, 771, 775, 776, 1.5; 220/371, 662, 665

[56] References Cited

U.S. PATENT DOCUMENTS

| | | | |
|---|---|---|---|
| D. 222,581 | 11/1971 | Nakakuma | 206/705 |
| 3,627,122 | 12/1971 | Garbe, Jr. | 206/1.5 |
| 4,290,467 | 9/1981 | Schmidt . | |
| 4,619,364 | 10/1986 | Czopor, Jr. | 206/470 |
| 4,736,849 | 4/1988 | Leonard et al. | 206/459.5 |
| 4,896,770 | 1/1990 | Calcerano et al. | 206/461 |
| 5,193,675 | 3/1993 | Otis . | |
| 5,211,287 | 5/1993 | Weisburn et al. | 220/665 |

FOREIGN PATENT DOCUMENTS

| | | | |
|---|---|---|---|
| 3139403 | 4/1983 | Germany | 206/459.5 |

*Primary Examiner*—Jim Foster
*Attorney, Agent, or Firm*—Collard & Roe, P.C.

[57] ABSTRACT

A display box for retail displays is provided. The display box has a top that has a plurality of equally sized compartments, and an upper compartment. A bottom is hingedly fastened to the top to enable access to the compartments. A display card having an elongated portion, a top and a display portion are disposed within the top of the display box such that the elongated portion encloses the plurality of compartments and provides a colorful background therefor. The top and display portion fit within the upper compartment such that the display portion is completely visible from the top side of the box. Thus, the retail goods can be seen through the transparent box and the header/display card can also be seen unobstructed without having to manipulate or change the position of the box.

5 Claims, 2 Drawing Sheets

DISPLAY BOX WITH DISPLAY CARD

BACKGROUND OF THE INVENTION

1. Field of the Invention

The present invention relates to display packages. More particularly, it relates to display box with display card for artificial fingernails.

2. The Prior Art

U.S. Pat. No. 4,290,467 to Schmidt, discloses a reclosable film plastic bags and method of making the same. The invention consists of a film bag that is sealed along the bottom and sides, and has an open top for receiving film. The front side of the bag has a portion dedicated for receiving identification means. As shown in FIGS. 1 and 2, a display card 26 is inserted into a pocket 29 formed between the front and back panels. The disposition of the display card on the front of the film bag without obstructing the view of the contents, is substantially similar to your above-referenced invention.

U.S. Pat. No. 5,193,675 to Otis, discloses a baby merchandise display package. The invention consists of a display box for baby shoes and a toy. The box has three staggered incline surfaces for displaying shoes, and another raised portion for displaying a toy. The package includes a protective sleeve that surrounds the display insert to permit viewing of the contents, while preventing touching and handling of the same. A gift card 54 is shown foldably mounted on the display box such that it overlays the protective sleeve. The gift card is displayed such that is partially covers the display of the package contents.

SUMMARY OF THE INVENTION

The present invention provides a display box for artificial fingernails. According to the invention, a clear plastic hinged display box has a top and bottom part. The top part has a plurality of compartments for receiving artificial fingernails, and an upper compartment for receiving a display card. A display or header card is removably disposed in the display box such that an upper display portion fits within the upper compartment, and an elongated lower portion covers the plurality of fingernail compartments and serves as a colorful backdrop therefor. After the display card is placed within the display box, the bottom of the box is closed and coupled to the top to prevent accidental opening. When the display box is placed in retail stores, the consumer will be able to see the artificial fingernails through the clear plastic housing and also be able to read the display card inserted therein without having to rotate or manipulate the display box.

It is therefore an object of the present invention to provide a display box that has a plurality of compartments for receiving specialized goods.

It is another object of the invention to provide a display box that enables the consumer to view the product and the product information from the same side of the display box.

It is a further object of the invention to provide a display box that utilizes a folded display card to provide a upper display portion and a lower background portion.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
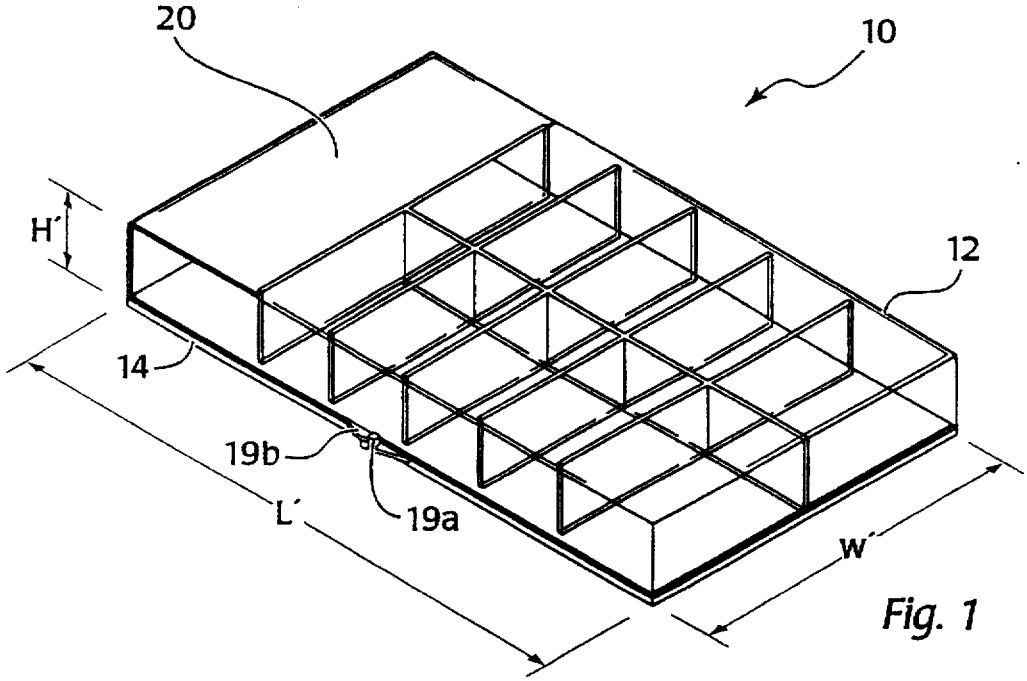
FIG. 1 is a perspective view of the display box with display card according to the invention.
Figure 2:
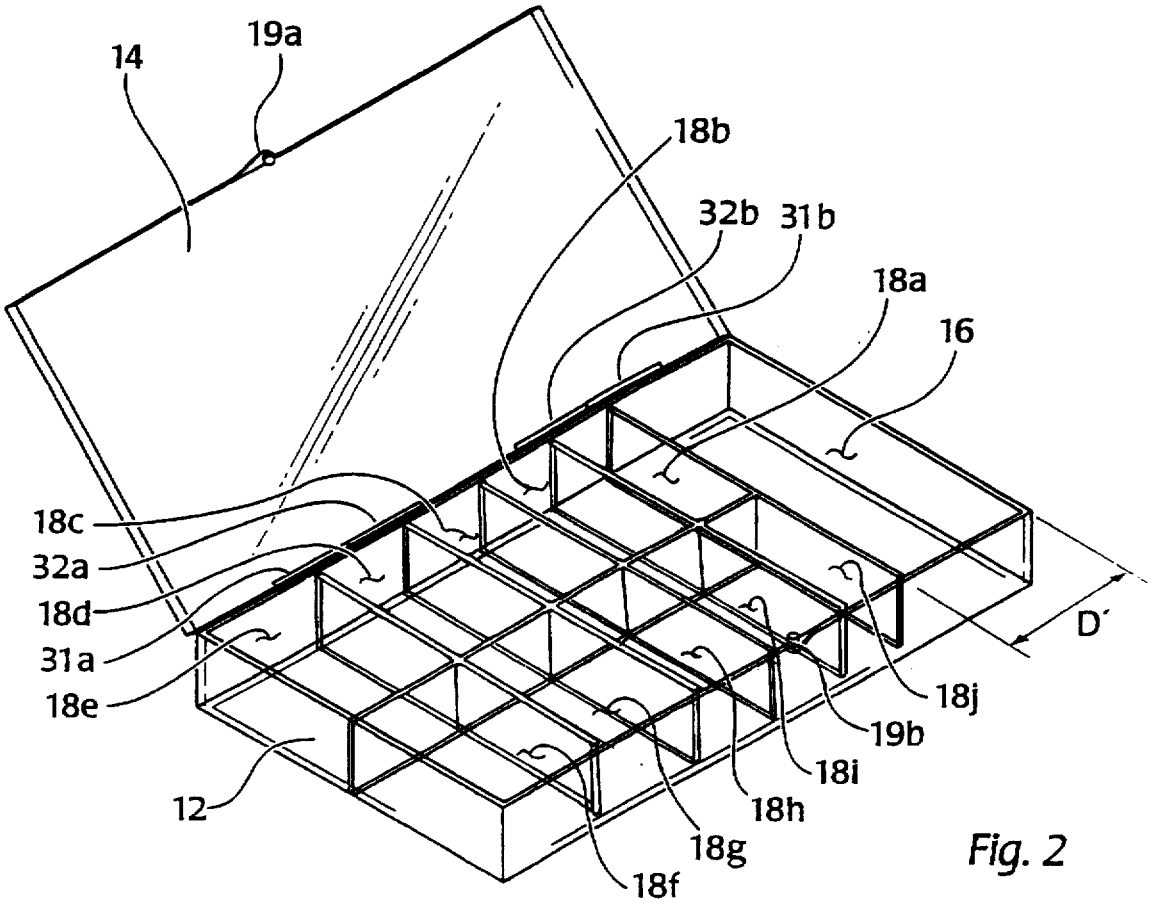
FIG. 2 is a perspective view of the display box opened according to the invention.

Turning now in detail to the drawings, FIGS. 1 and 2 show a reverse display box 10 having a top or box portion 12, a bottom cover 14 and a display card 20 within box 10. The top or box portion 12 is releasably coupled with bottom cover 14 by a snap clasp 17.

Figure 4:
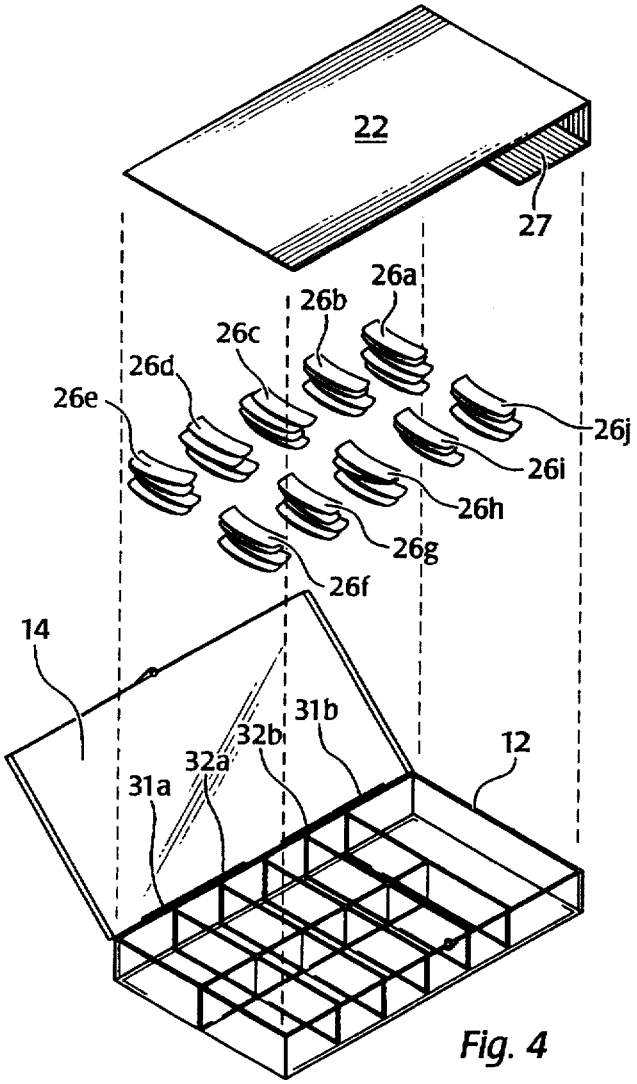
FIG. 4 is an exploded perspective view of the display box with display card according to the invention.

The box portion 12 of display box 10, includes an upper compartment 16, and a plurality of smaller compartments **18*a*–18*j* for receiving and containing artificial fingernails 26*a*–26*j*, respectively (see FIG. 4). Compartments 18*a*–18*j* can be graduated in size (FIG. 2) and be filled with varying size nails to accommodate different size fingers. In another embodiment, compartments 18*a*–18*j* can be equal in size for receiving goods of the same size. Box portion 12 and bottom cover 14** are preferably made from a transparent plastic, but can be made from any other suitable known type of transparent material.

As shown in FIG. 2, in order to open box 10 without causing fingernails **26*a*–26*j* from falling out, the user must turn over said box such that the bottom cover 14 can be opened and box portion 12** remains with the compartment openings facing upward.

Figure 3:
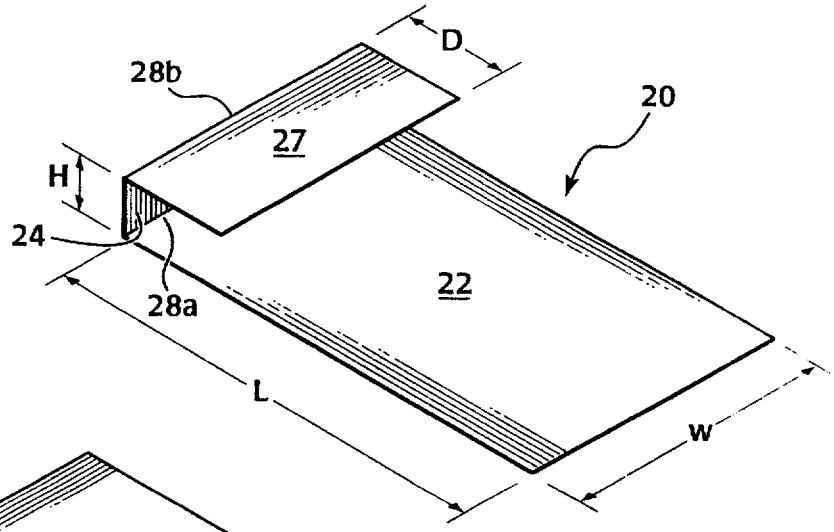
FIG. 3 is a perspective view of the display card according to the invention.

FIG. 3 shows a display card 20 according to the invention. Card 20 has an elongated portion 22 having a length L substantially equal to the length L' of box 10 such that said header card fits entirely within said box when it is closed (FIG. 1). Display card 20 has a top part 24 that has a height H substantially equal to the height H' of box 10 (FIG. 1). Top part 24 is formed by folding card 20 along fold line **28*a* such that said top part is disposed at an angle substantially perpendicular with respect to elongated portion 22. A header display portion 27 is disposed at a right (perpendicular) angle with respect to top part 24 along a second fold line 28*b*. Display portion 27 has a dimension D that is substantially equal to the dimension D' across the opening in upper compartment 16**.

FIG. 4 shows an exploded view of the display box with header card according to the invention. As shown, artificial fingernails **26*a*–26*j* are placed in compartments 18*a*–18*j*, respectively, and display card 20 is then placed in over the compartments. When display card 20 is disposed over compartments 18*a*–18*j*, header display portion 27 fits entirely within upper compartment 16 and elongated portion 22 provides a backing to compartments 18*a*–18*j*. Once display card 20 is in place, the bottom cover 14 can be closed and held shut snap clasp 17**, thereby allowing the consumer to view the goods from the top/front without flipping the box.

In this configuration, artificial nails **26*a*–26*j* or other articles of merchandise are inserted into compartments 18*a*–18*j*. Display card 20 is disposed in the box such that elongated portion 22 becomes the backing of the compartments, and header display portion 27 is shown in upper compartment 16. Header display portion 27 includes a printed display and artwork for the products contained within compartments 18***a*–18*j*. Therefore, when bottom cover 14 is closed and coupled to box portion 12, display box 10 can show all of the nails 26*a*–26*j* within compartments 18*a*–18*j*, respectively, through the top 12 without obstructing the view of display portion 27. Since display portion 27 is also separated from the good compartments 18*a*–18*j*, said display portion does not obstruct the view of the goods contained in box portion 12.

Box portion 12 and bottom cover 14 are hingedly coupled together by hinges 31*a*,31*b*, 32*a* and 32*b*, which can be any suitable hinge system. Cover 14 has a margin around it to enclose the periphery of box portion 12. Header card 20 is preferably a stiff card so as to remain rigid within the box, but is sufficiently thin to fit between the compartment and the cover so that cover 14 can close tightly over the card.

While one embodiment of the present invention have been shown and described, it is to be understood that many changes and modifications may be made thereunto without departing from the spirit and scope of the invention as defined in the appended claims.

What is claimed is:

1. A transparent display box for displaying goods comprising:

a top portion having a plurality of spaced apart compartments for receiving the goods to be displayed, and a further compartment for receiving a display;

a bottom cover portion for releasably closing said top portion, and the goods contained therein; and a display for advertising the goods in said plurality of compartments, said display comprising a display card having disposed in said further compartment comprising a display card having an elongated portion, a top, and a header display portion, said display card being disposed in said top portion of the display box such that said header display portion fits within said further compartment, and said elongated portion encloses said plurality of compartments, so that said display and the goods within said plurality of compartments are visible through said top portion of the display box without obstructing the view of the displayed goods.

2. The display box according to claim 1, wherein said display card includes a first fold line and a second fold line, said first fold line separating said top from said elongated portion, and said second fold line separating said top from said header display portion.

3. The display box according to claim 2, wherein said elongated portion of said display card is disposed substantially perpendicular to said top along said first fold line, and said header display portion is disposed substantially perpendicular to said top of said display card along said second fold line.

4. The display box according to claim 1, wherein each of said plurality of compartments are graduated in size to receive goods of varying sizes.

5. The display box according to claim 1, wherein each of said plurality of compartments are the same size.

* * * * *